US008905044B2

(12) United States Patent
Park

(10) Patent No.: US 8,905,044 B2
(45) **Date of Patent: *Dec. 9, 2014**

(54) MULTI-LAYERED COLOR-ENHANCING NAIL APPLIQUE

(76) Inventor: Fa Young Park, Leonia, NJ (US)

( * ) Notice: Subject to any disclaimer, the term of this patent is extended or adjusted under 35 U.S.C. 154(b) by 0 days.

This patent is subject to a terminal disclaimer.

(21) Appl. No.: 12/773,135

(22) Filed: May 4, 2010

(65) Prior Publication Data

US 2010/0212681 A1 Aug. 26, 2010

Related U.S. Application Data

(63) Continuation-in-part of application No. 12/615,410, filed on Nov. 10, 2009, now abandoned, which is a continuation-in-part of application No. 12/183,385, filed on Jul. 31, 2008, now Pat. No. 8,061,364, which is a continuation-in-part of application No. 12/138,701, filed on Jun. 13, 2008, now Pat. No. 8,061,363, which is a continuation-in-part of application No. 11/866,678, filed on Oct. 3, 2007, now abandoned, which is a continuation-in-part of application No. 11/543,481, filed on Oct. 5, 2006, now Pat. No. 8,092,786, which is a continuation-in-part of application No. 11/126,862, filed on May 11, 2005.

(60) Provisional application No. 60/570,713, filed on May 12, 2004.

(51) Int. Cl.
*A45D 29/00* (2006.01)

(52) U.S. Cl.
CPC ..... *A45D 29/001* (2013.01)
USPC ..... 132/73

(58) Field of Classification Search
USPC ..... 132/73, 285; 206/581
See application file for complete search history.

(56) References Cited

U.S. PATENT DOCUMENTS

| | | | |
|---|---|---|---|
| 1,238,046 | A | 8/1917 | Hxrtrss et al. |
| 2,013,290 | A | 9/1935 | Rohrbach et al. |
| 2,048,912 | A | 7/1936 | Ziska et al. |
| 2,162,155 | A | 6/1939 | Calvin el al. |

(Continued)

FOREIGN PATENT DOCUMENTS

| | | |
|---|---|---|
| CA | 2461251 | 9/2005 |
| CH | 559019 | 12/1972 |

(Continued)

OTHER PUBLICATIONS

Office Action dated Sep. 2, 2008 in connection with U.S. Appl. No. 11/126,862.

(Continued)

*Primary Examiner* — Robyn Doan
(74) *Attorney, Agent, or Firm* — Carrie Stroup

(57) ABSTRACT

A dry nail polish appliqué to be applied to a fingernail. The nail appliqué has several layers. A bottom layer hides the color of the natural nail upon which the appliqué is applied. A top layer of a different color is applied on top of the color-hiding layer. The color of the top layer is, as such, uninfluenced by the natural nail color and it therefore appears sharp and crisp. The top layer could be of a translucent quality such that the top layer and bottom layer visually combine to produce a unique appearance.

16 Claims, 7 Drawing Sheets

(56) References Cited

U.S. PATENT DOCUMENTS

| | | | | |
|---|---|---|---|---|
| 2,234,657 | A | 3/1941 | Smaldone et al. | |
| 2,239,040 | A * | 4/1941 | Holmes | 132/285 |
| 2,581,982 | A | 1/1952 | Terry et al. | |
| 2,688,331 | A | 9/1954 | Bogoslowsky et al. | |
| 2,746,460 | A * | 5/1956 | Jellinek | 132/73 |
| 2,764,168 | A | 9/1956 | Herz | |
| 2,816,555 | A * | 12/1957 | Klump | 132/73 |
| 3,023,887 | A * | 3/1962 | Cohen | 132/73 |
| 3,603,286 | A | 9/1971 | Scopp et al. | |
| 3,993,084 | A | 11/1976 | Cullen | |
| 4,126,144 | A | 11/1978 | Duarte | |
| 4,158,053 | A | 6/1979 | Greene et al. | |
| 4,169,825 | A | 10/1979 | Yapp et al. | |
| 4,283,324 | A | 8/1981 | Duffy et al. | |
| 4,511,608 | A | 4/1985 | Ferraro | |
| 4,824,702 | A | 4/1989 | Straub | |
| 4,903,840 | A * | 2/1990 | So | 206/581 |
| 4,947,876 | A | 8/1990 | Larsen | |
| 4,954,190 | A | 9/1990 | Taeckens | |
| 5,070,892 | A | 12/1991 | Trematerra | |
| 5,096,750 | A | 3/1992 | Edlert et al. | |
| 5,118,495 | A | 6/1992 | Nafziger et al. | |
| 5,206,011 | A | 4/1993 | Pappas et al. | |
| 5,316,026 | A | 5/1994 | Jenkins | |
| 5,415,903 | A | 5/1995 | Hoffman et al. | |
| 5,525,389 | A * | 6/1996 | Hoffmann et al. | 428/41.5 |
| 5,782,248 | A | 7/1998 | Chang | |
| 5,866,106 | A | 2/1999 | Papay | |
| 5,908,035 | A | 6/1999 | Carroll et al. | |
| 6,042,679 | A | 3/2000 | Holt et al. | |
| D445,543 | S | 7/2001 | Amen-Ra A | |
| 6,296,836 | B1 * | 10/2001 | Engler | 424/61 |
| 6,303,140 | B1 | 10/2001 | Dever et al. | |
| 6,352,687 | B1 | 3/2002 | Ismailer et al. | |
| 6,354,304 | B1 | 3/2002 | Chang | |
| D459,547 | S | 6/2002 | Wada et al. | |
| 6,472,039 | B1 | 10/2002 | Amen-Ra A | |
| 6,565,835 | B1 | 5/2003 | Socci et al. | |
| 6,626,183 | B1 | 9/2003 | Pietrocola et al. | |
| 6,797,261 | B1 | 9/2004 | Le | |
| 7,143,770 | B1 | 12/2006 | Keller | |
| 8,061,363 | B2 | 11/2011 | Park | |
| 8,061,364 | B2 | 11/2011 | Park | |
| 8,092,786 | B2 | 1/2012 | Park | |
| 2002/0106493 | A1 | 8/2002 | Komuta et al. | |
| 2002/0197435 | A1 * | 12/2002 | Ra A | 428/42.1 |
| 2003/0175225 | A1 | 9/2003 | Leacock et al. | |
| 2003/0198611 | A1 | 10/2003 | Glassman et al. | |
| 2003/0217758 | A1 | 11/2003 | Mesirow | |
| 2004/0079381 | A1 | 4/2004 | Han | |
| 2005/0061342 | A1 | 3/2005 | Chapman | |
| 2005/0121048 | A1 | 6/2005 | Han | |
| 2005/0150508 | A1 | 7/2005 | Downs et al. | |
| 2005/0199253 | A1 * | 9/2005 | Fiore et al. | 132/73 |
| 2005/0255061 | A1 | 11/2005 | Park | |
| 2007/0025936 | A1 | 2/2007 | Park | |
| 2008/0087291 | A1 | 4/2008 | Jordan | |
| 2008/0236603 | A1 | 10/2008 | Park | |
| 2008/0276951 | A1 | 11/2008 | Park | |
| 2008/0283073 | A1 | 11/2008 | Park | |
| 2009/0233031 | A1 | 9/2009 | Weber et al. | |
| 2010/0047301 | A1 | 2/2010 | Park | |
| 2010/0212681 | A1 | 8/2010 | Park | |
| 2011/0117174 | A1 | 5/2011 | Kergosien et al. | |
| 2012/0103354 | A1 | 5/2012 | Park | |
| 2013/0139839 | A1 | 6/2013 | Chang | |
| 2013/0206157 | A1 | 8/2013 | Park | |
| 2013/0220355 | A1 | 8/2013 | Park | |

FOREIGN PATENT DOCUMENTS

| | | | |
|---|---|---|---|
| FR | 1186543 | | 8/1959 |
| JP | 2001353022 | | 12/2001 |
| JP | 3243694 | | 1/2002 |
| JP | 200285148 | | 3/2002 |
| WO | 8802226 | | 4/1988 |
| WO | 8802227 | | 4/1988 |
| WO | 2005112873 | | 12/2005 |
| WO | 2008045282 | | 4/2008 |
| WO | 2011141876 | A1 | 11/2011 |
| WO | 2012021244 | A1 | 2/2012 |
| WO | 2012061519 | | 5/2012 |
| WO | 2013155094 | A1 | 10/2013 |

OTHER PUBLICATIONS

Office Action dated Oct. 6, 2009 in connection with U.S. Appl. No. 11/126,862.
Office Action dated Jun. 23, 2010 in connection with U.S. Appl. No. 11/126,862.
Office Action dated Jan. 21, 2011 in connection with U.S. Appl. No. 11/126,862.
Office Action dated Nov. 18, 2009 in connection with U.S. Appl. No. 11/866,678.
Office Action dated May 27, 2010 in connection with U.S. Appl. No. 11/866,678.
Office Action dated Dec. 22, 2010 in connection with U.S. Appl. No. 11/866,678.
Office Action dated Oct. 4, 2011 in connection with U.S. Appl. No. 11/866,678.
Office Action dated Sep. 5, 2012 in connection with U.S. Appl. No. 11/866,678.
Office Action dated Apr. 16, 2013 in connection with U.S. Appl. No. 11/866,678.
Office Action dated Jul. 9, 2013 in connection with U.S. Appl. No. 11/866,678.
Office Action dated Jan. 7, 2009 in connection with U.S. Appl. No. 11/543,481.
Office Action dated Sep. 14, 2009 in connection with U.S. Appl. No. 11/543,481.
Office Action dated Apr. 2, 2010 in connection with U.S. Appl. No. 11/543,481.
Office Action dated Feb. 14, 2011 in connection with U.S. Appl. No. 12/138,701.
Office Action dated Feb. 14, 2011 in connection with U.S. Appl. No. 12/183,385.
Office Action dated Jul. 26, 2011 in connection with U.S. Appl. No. 12/615,410.
Office Action dated Mar. 6, 2012 in connection with U.S. Appl. No. 12/615,410.
Office Action dated Aug. 23, 2012 in connection with U.S. Appl. No. 12/615,410.
Office Action dated Jun. 7, 2013 in connection with U.S. Appl. No. 121615,410.
Office Action dated Sep. 26, 2012 in connection with U.S. Appl. No. 13/287,880.
Office Action dated Jul. 11, 2013 in connection with U.S. Appl. No. 13/287,880.
Office Action dated Mar. 30, 2010 in connection with Australian Patent Application No. 2005244843.
Office Action dated Sep. 9, 2011 in connection with Australian Patent Application No. 2005244843.
Office Action dated Jan. 25, 2010 in connection with Canadian Patent Application No. 2,566,113.
Office Action dated Jan. 26, 2011 in connection with Canadian Patent Application No. 2,566,113.
Office Action dated Mar. 6, 2012 in connection with Canadian Patent Application No. 2,566,113 171.
Office Action dated Apr. 9, 2013 in connection with Canadian Patent Application No. 2,566,113.
Office Action dated Dec. 18, 2012 in connection with Japanese Patent Application No. 2009-531450.
Office Action dated Dec. 28, 2011 in connection with Korean Application No. 10-2006-7026131.
Office Action dated Sep. 28, 2012 in connection with Korean Application No. 10-2006-7026131.

(56) References Cited

OTHER PUBLICATIONS

Office Action dated Jun. 3, 2013 in connection with Korean Application No. 10-2013-7002868.
Office Action dated Jul. 14, 2008 in connection with Russian Application No. 2006138905/15.
Office Action dated Feb. 24, 2011 in connection with Russian Application No. 2010107190112.
International Search Report and Written Opinion dated May 4, 2006 for International Patent Application No. PCT/US2005/016667.
International Search Report and Written Opinion dated Jun. 16, 2008 for International Patent Application No. PCT/US2007/021305.
International Search Report and Written Opinion dated Mar. 16, 2013 for International Patent Application No. PCT/US2011/059000.
International Search Report and Written Opinion dated Jul. 31, 2093 for International Patent Application No. PCT/US2013/35817.
All About Coconut Oil and Nail Fungus. http://nailfungustreatmentguide.org/coconut-oil-nail-fungus/ (Aug. 11, 2011).

* cited by examiner

MULTI-LAYERED COLOR-ENHANCING NAIL APPLIQUE

RELATED APPLICATIONS

The current application is a Continuation-In-Part of pending U.S. patent application Ser. No. 12/615,410, filed Nov. 10, 2009, which is a Continuation-In-Part of pending U.S. patent application Ser. No. 12/183,385 filed on Jul. 31, 2008, now U.S. Pat. No. 8,061,364 which itself is a Continuation-In-Part of pending U.S. patent application Ser. No. 12/138,701 filed on Jun. 13, 2008, now U.S. Pat. No. 8,061,363 which is a Continuation-In-Part of pending U.S. patent application Ser. No. 11/866,678 filed on Oct. 3, 2007, which is a Continuation-In-Part of pending U.S. patent application Ser. No. 11/543,481 filed Oct. 5, 2006, now U.S. Pat. No. 8,092,786 which is itself a Continuation-In-Part of U.S. patent application Ser. No. 11/126,862, filed on May 11, 2005, which claims domestic priority from U.S. Provisional Patent Application No. 60/570,713, filed on May 12, 2004. The contents of each of the above-mentioned patent applications are incorporated by reference herein.

FIELD OF THE INVENTION

The current invention relates generally to the field of nail polish appliqués, more specifically to a multi-layered appliqué for enhancing the color of appliqués.

BACKGROUND OF THE INVENTION

Nail polish is a popular nail adornment. Traditional nail polish is brushed onto a fingernail in a liquid form. More recently, advancements to the art have been made by the instant inventor, whereby nail polish is applied as a dry nail polish appliqué obviating the need for a liquid polish and avoiding the disadvantages associated with applying a liquid product. Dry nail polish appliqués are comprised of liquid nail enamel that is applied to a substrate. Before the enamel is fully dried—it is sealed in a protective package to prevent complete drying. The enamel thus fully cures on a fingernail once applied thereto—similarly to the manner in which conventional nail polish cures.

Nail polish, both thy and liquid, come in various colors, textures and styles One problem associated with many of the common nail polish styles is that once applied to a fingernail, the natural color of the nail bed shows through the nail polish layer. As a result, the color of the nail polish is diminished, and it is not as lustrous as possible. In order to completely neutralize the effect of the underlying nail color, one would need to apply more than one layer—and sometimes several—in order to achieve a desired effect. With liquid nail polish, one would need to wait for each coat to dry completely before applying another.

SUMMARY OF THE INVENTION

The present invention is directed to a novel multi-layered appliqué having at least a bottom layer and a top layer. The bottom layer effectively hides the color of the natural nail ("color-hiding layer" or "bottom layer") and the top layer, provides a color ("color layer" or "top layer") The top layer, applied on top of color-hiding layer, is thus uninfluenced by the color of a wearer's natural nail. As a result, the color layer is brilliant and pure.

Both layers are part of a unitary appliqué and they are, as such, applied when the appliqué is applied to a fingernail.

In some embodiments, the color-hiding layer is white and a layer of a second color is applied atop thereto. The white layer functions to hide the natural nail and is not outwardly visible once the nail appliqué is applied. The color layer—applied on top of the white layer—is outwardly visible when applied to a fingernail.

In another embodiment, the bottom and top layers combine to produce a complementary visual effect In this embodiment, the bottom layer functions to hide the color of a natural nail, but it also visually combines with the layer on top to produce a unique appearance. In one example, the bottom layer is a coating having a metallic sheen ("metallic layer") and a colored, translucent layer is applied on top of the metallic layer The metallic layer obscures the color of the underlying nail, but it also is visible through the translucent layer disposed on top thereof. The combined effect of the metallic and top, translucent layers produce a unique bright and/or textured look that is not possible to create with prior art methods.

DETAILED DESCRIPTION OF THE INVENTION

Figure 1:
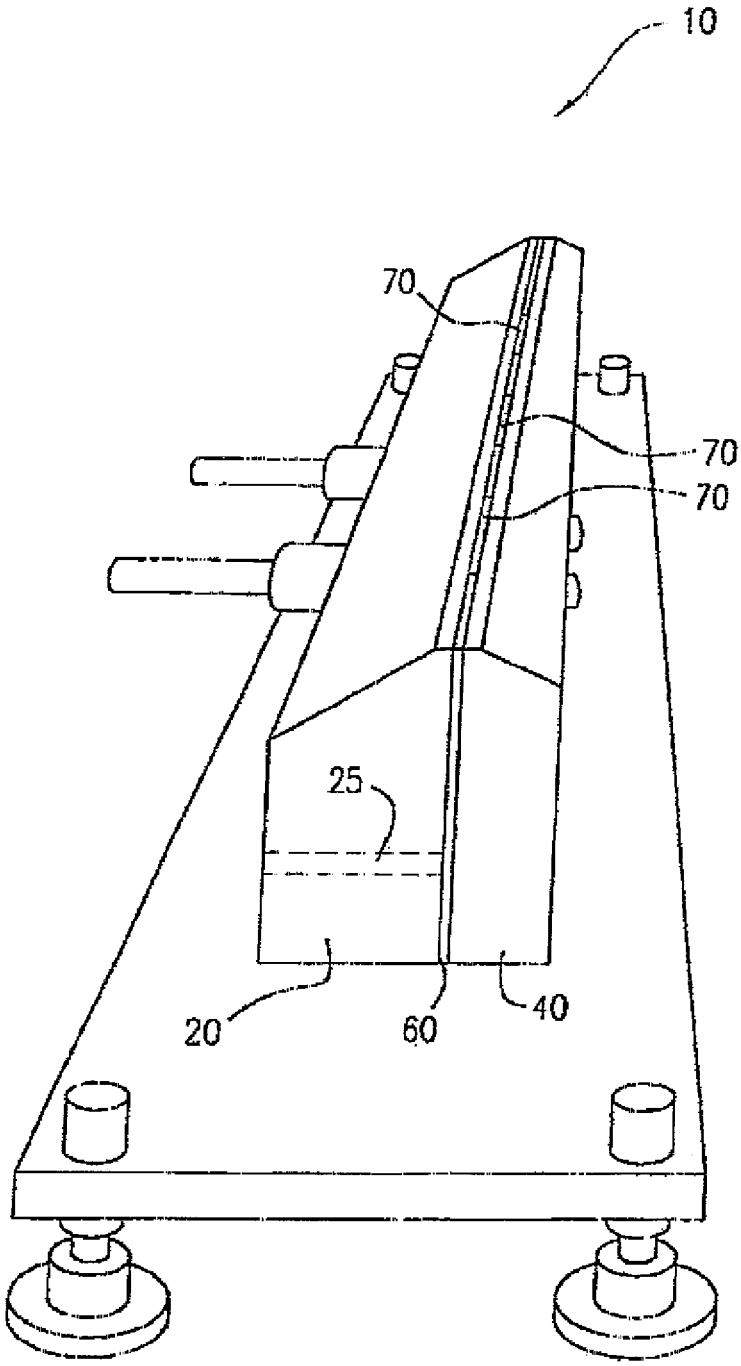
FIG. 1 is a bottom perspective view of a slot coating die used in the inventive method.

The following is a detailed description of the preferred embodiments of the invention, reference being made to the drawings in which the same reference numerals identify the same elements of structure in each of the several figures. It should be noted that these drawings are merely exemplary in nature and in no way serve to limit the scope of the invention, which is defined by the claims appearing herein below.

Figure 2:
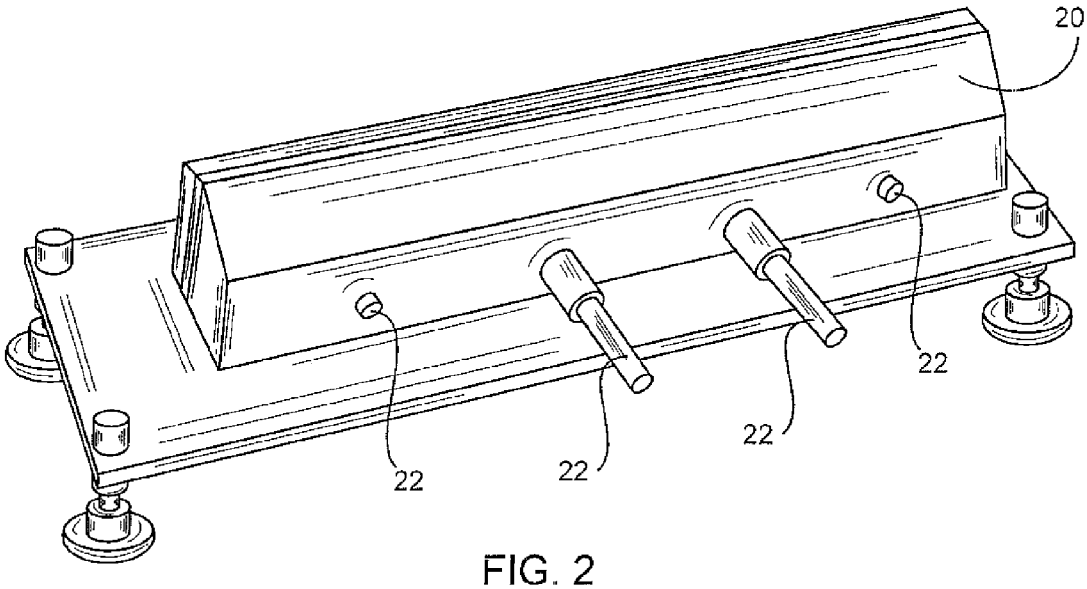
FIG. 2 front bottom perspective view of the slot coating die of FIGS. 1

The various coatings of the product are applied via a technique referred to herein as "slot curtain die coating." The die in question is shown in FIGS. 1-4 in various states of assembly as die 10. As best shown in FIG. 1, die 10 includes front die section 20, rear die section 40, and a specially shaped shim 60 disposed therebetween. All three parts are tightly secured together, preferably by bolting, e.g., by bolts 24 (see FIG. 6). Referring to FIG. 2, front die section 20 includes inlets 22 which feed internal bores 25 with liquid nail enamel or any of the other components of the product, such as for example adhesive and additive or a top, clear layer.

Figure 3:
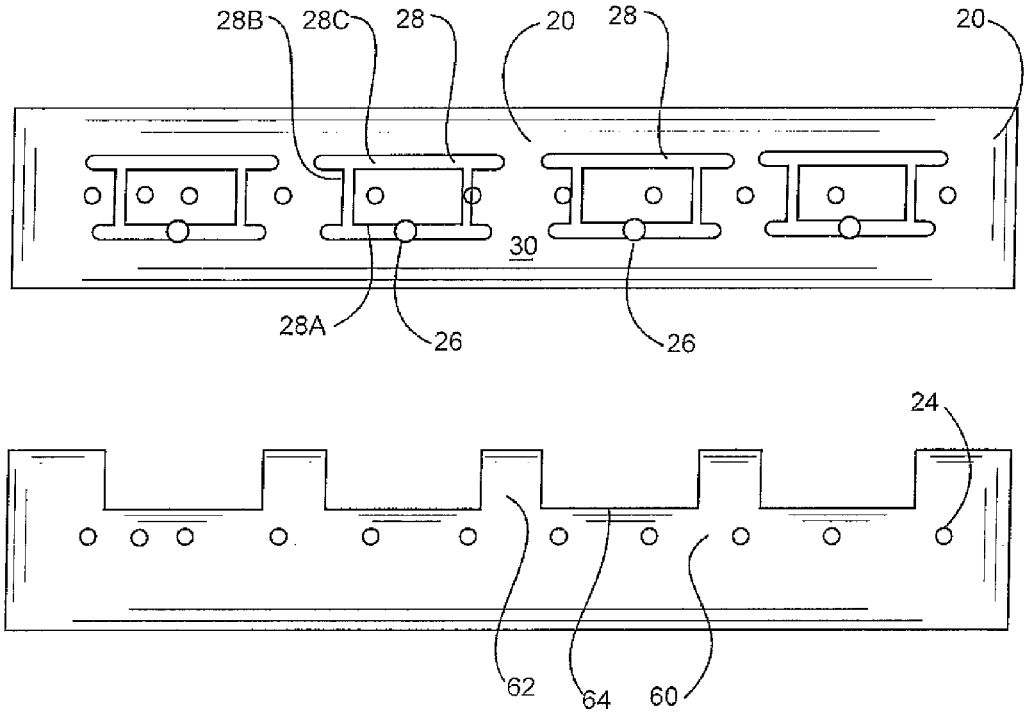
FIG. 3 is an elevational view of a shim and half of the slot coating die of FIG. 1 dissembled.
Figure 4:
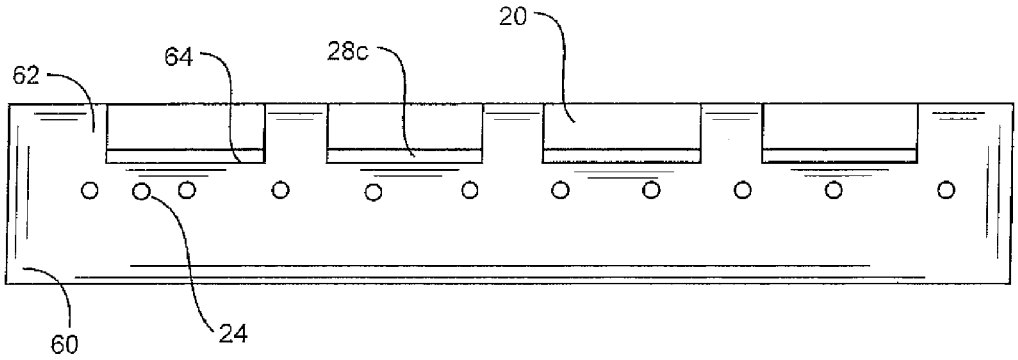
FIG. 4 is an elevational view of the shim and die half of FIG. 3 assembled.

FIGS. 3 and 4 illustrate the interior of die 10; in both of these figures, rear die section 40 has been removed for clarity. Internal bores 25 of front die section 20 terminate in outlet holes 26 on inner face 30 and reside in flow channels 28 thereon. The purpose of flow channels 28 is to direct the liquid nail enamel from outlet holes 26 in a manner that results in consistent and even application of the enamel on the substrate. As such, each flow channel 28 includes upper substantially horizontal branch 28A, which feeds into substantially vertical branches 28B and thence into lower substantially horizontal branch 28C. It should be noted that die 10 is shown in FIGS. 1-4 upside down; hence, fluid exiting outlet hole 26 seeps along horizontal branch 28A, down vertical branches 28B, and then seeps into horizontal branch 28C. The liquid enamel seeps from branch 28C and onto the substrate.

Without shim 60, the two inner faces of front and rear die sections 20 and 40 would be firmly abutting and would not allow room for the enamel to seep out of horizontal branch 28C. However, as shown in FIGS. 3 and 4, shim 60 includes vertical projections 62 between cutouts 64. When shim 60 is attached to front die section 20 by bolts 24 (see FIG. 4), it shields and covers all of flow channel 28 except for the majority of lower horizontal branch 28C. This way, enamel flowing in branches 28A or 28B cannot seep out of these branches but must instead move forward (downward) ultimately to branch 28C. Because branch 28C is uncovered, enamel simply spills out of it and thus out of slots 70 (see FIG. 1) and onto the substrate in a sheet-like or curtain-like configuration.

Figure 5:
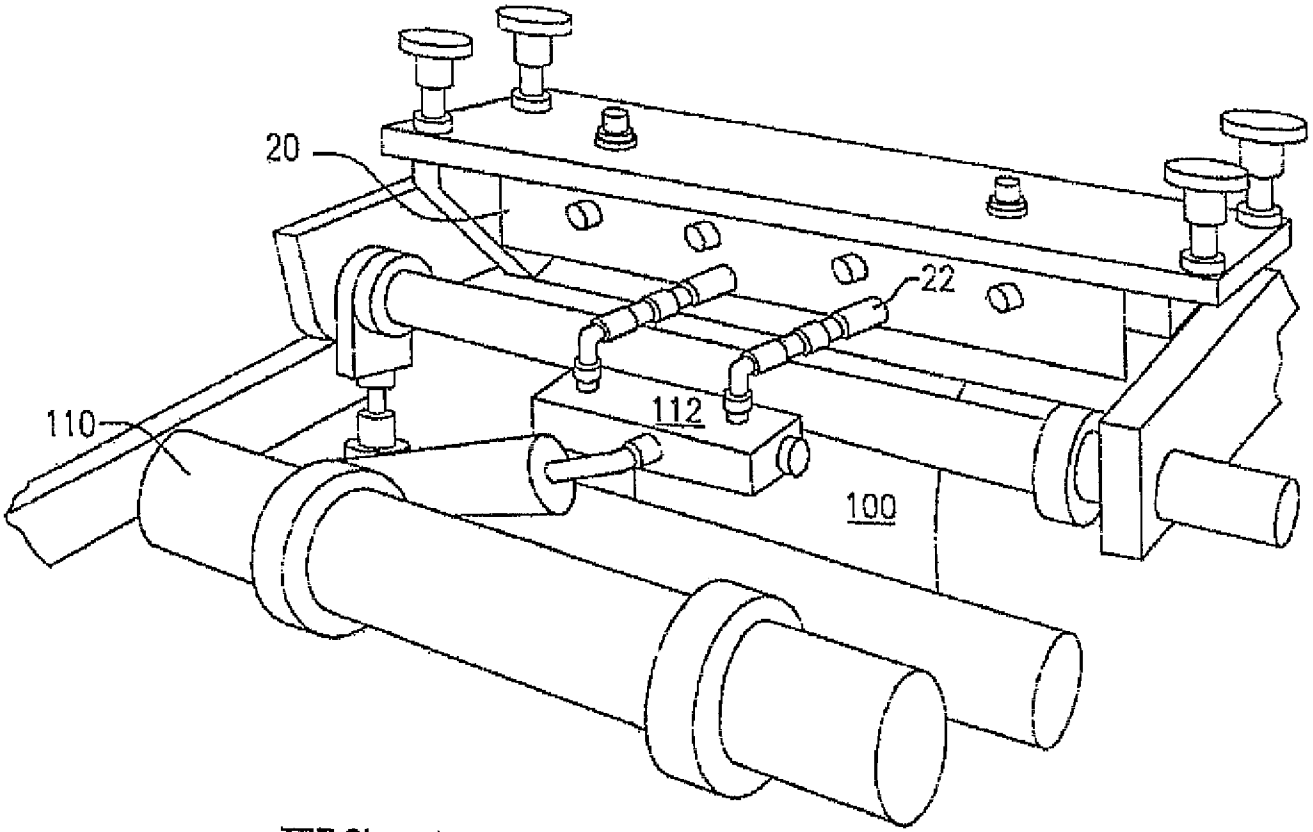
FIG. 5 is a front perspective view of a coating apparatus used in the inventive method.
Figure 6:
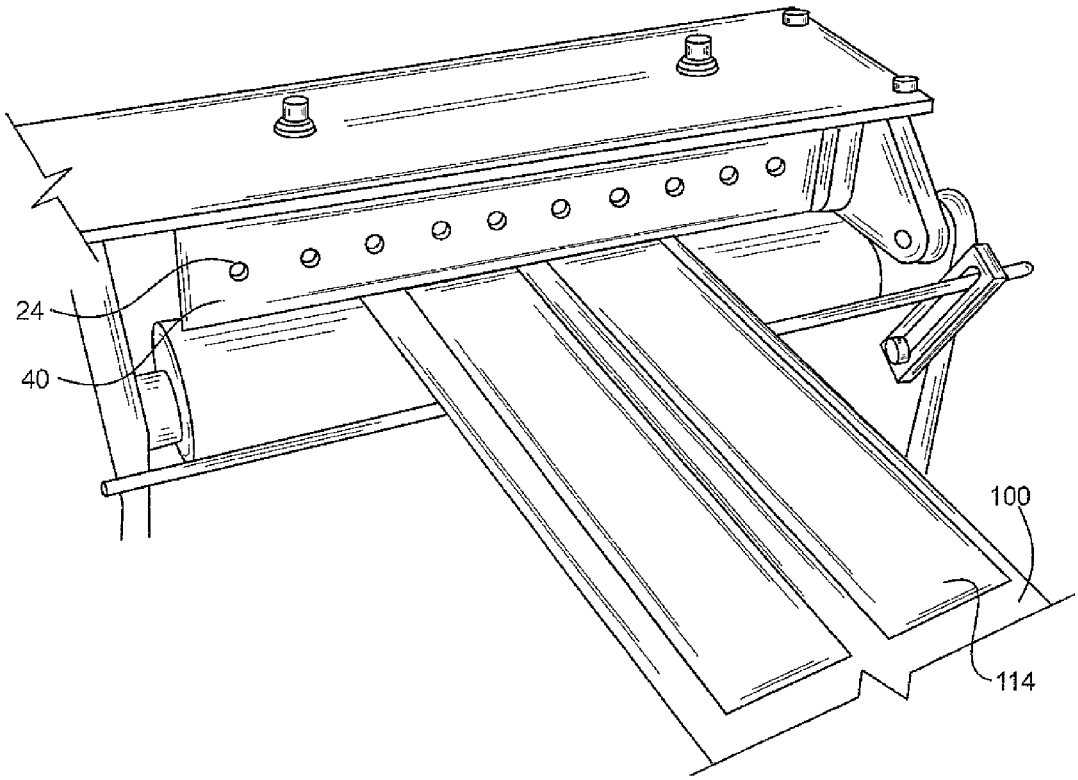
FIG. 6 is a rear perspective view of the coating apparatus of FIG. 5

More specifically, as best illustrated in FIGS. 5 and 6, substrate 100 is fed into the machinery by rollers 110. Liquid enamel source 112 is attached to inlets 22 so that heated, pressurized liquid enamel can be forced into die 10. When substrate 100 passes under die 10, liquid enamel or other components being coated, drop from slots 70 and onto substrate 100 thereby forming layer 114

The first substance to be applied to substrate 100 is an adhesive material. Nail enamel layers are applied atop of the adhesive layer. The adhesive layer secures the appliqué to a fingernail. After the adhesive is applied, at least two additional layers are applied as described above.

Preferably, the color-hiding layer is applied directly on top of the adhesive layer and the color layer is applied atop thereof. In some embodiments one or more clear layers are applied atop of the color layer. After each layer is applied to the substrate, the enamel is partially dried by way of heaters and/or blowers. Once one layer is partially dried as such, another layer is applied atop thereof in the manner described above. Once the final, top layer is applied, it too is only partially dried (by "partially" it is meant that the enamel is mostly dried—e.g. >85%).

A Metallic layer could be applied in any of various ways. For example, in a preferred embodiment metallic material is mixed with a liquid nail enamel and applied in the manner described above. Alternatively, metallic materials could be sprayed directly onto enamel layers—without first being mixed with nail enamel.

Figure 7:
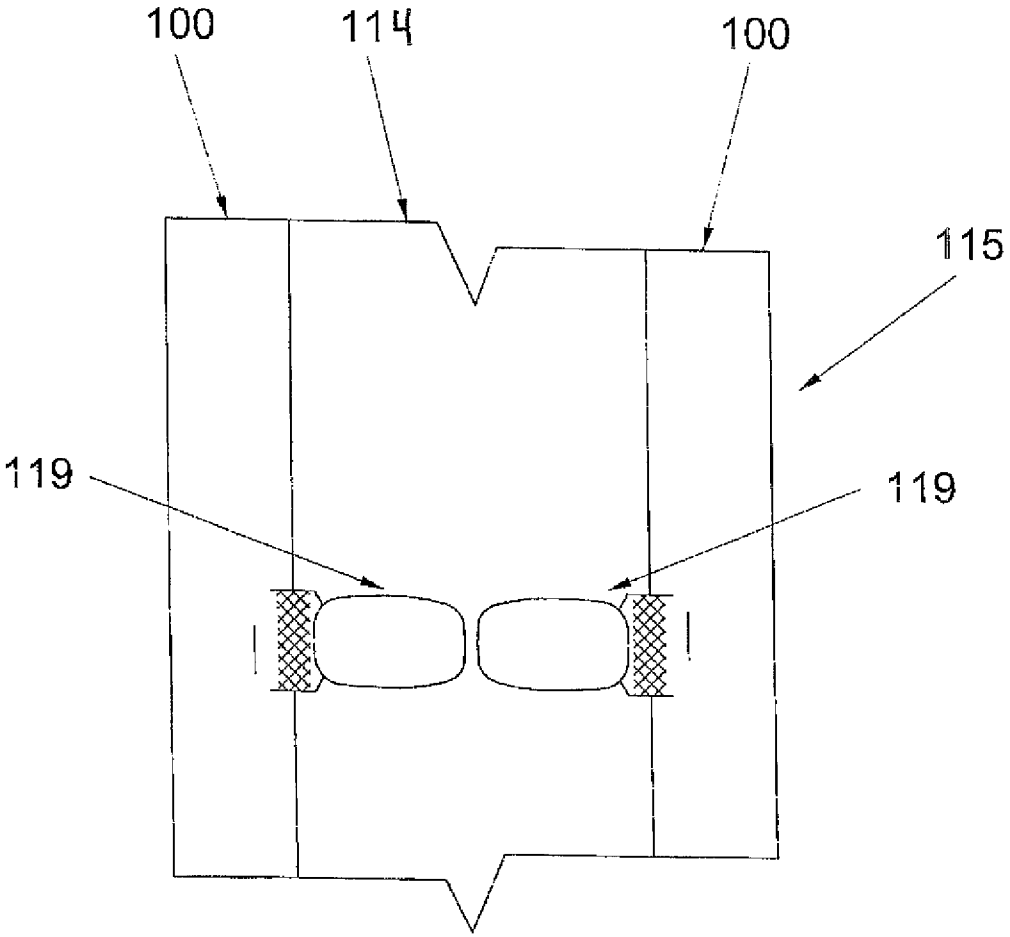
FIG. 7 is a schematic view of a set of nail appliqués.

After all layers are applied to the substrate, the substrate is cut into several nail-shaped appliqués. In FIG. 7, a sheet 115 having a strip of nail enamel 114 is shown from which individual appliqués 119 are cut. (Note that for illustrative purposes, FIG. 7 shows two opposing appliqués as they would be cut from strip 114. In embodiments of the invention, any of various numbers of appliqués could be cut from strip 114) The sheet 115 is then sealed in an airtight package to prevent complete drying of the appliqué. In this manner, an appliqué will completely dry on the fingernail of a wearer—yet considerably faster than drying times required for traditional nail polish applied with a brush.

Figure 8:
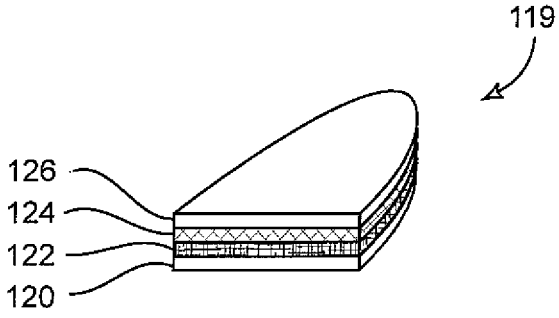
FIG. 8 is a schematic view of a nail appliqué having four layers, according to an embodiment of the invention.

FIG. 8 shows a schematic view of a single appliqué 119 showing the various layers as discrete layers. The bottom most layer is the adhesive layer 120. Directly above layer 120 is the color-hiding layer 122. Color layer 124 is applied on top of color-hiding layer 122. A clear layer 126 is applied on top of color layer 124.

Adhesive layer 120 is in direct contact with a wearer's fingernail for securing an appliqué thereto. The color-hiding layer 122 is applied on top of the adhesive layer In one embodiment the color-hiding layer 122 is comprised of a white shade of nail enamel, however, substantially any light, neutral color such as various shades of off-white, gray, pearl, beige and the like may be used. A color layer 124 of a different color enamel is applied on top of color-hiding layer 122. In some embodiments, color layer 124 comprises any of various neon colors. Because the natural color of the nail is blocked by color-hiding layer 120, the natural nail color does not show through the neon layer. As a result, the neon color is expressed brilliantly and unaffected by the natural nail color.

This embodiment presents an improvement over the state of the art, whereby neon-colored nail polish applied with a brush could not achieve a neon appearance that is not hampered by the color of the underlying nail bed. The current embodiment, on the other hand, allows for the application of a crisp and pure neon nail covering.

In another embodiment of the invention, the color-hiding layer dually functions to, both, hide the natural nail and to enhance the look of the color layer in a complementary fashion. In this embodiment, a color layer 124 that is applied on top of a color-hiding layer 122 has a translucent property. The color layer 124, thus visually combines with the underlying color-hiding layer 122 to produce a unique appearance. In one example, a color-hiding layer 122 is a shade of white and a layer applied atop thereof is a neon color. The neon color has a translucent quality and as such allows some of the underlying color to come through. However, because the layer below the neon layer is a shade of white—it adds brilliance and life to the neon. The color-hiding layer 122 and the color (neon) layer 124, thus combine to produce a unique and bright neon appearance (By "translucent quality" it is meant that some of the color underneath the neon layer slightly shows through the neon layer to the extent that it affects or influences the quality of the neon color. For example, if the neon color were applied atop a black colored layer—the neon would appear to be dull, whereas if the neon layer is applied atop of a white layer, the white color showing through the neon actually enhances the quality and brightness of the neon.)

In other embodiments, instead of being a shade of white, the color-hiding layer 122 is a metallic material, such as high sheen aluminum that is combined with nail enamel. The metallic layer hides the natural nail color, and it additionally is outwardly visible through a colorful, translucent layer (corresponding to layer 124—i.e., the one above the color-hiding layer) that is applied atop thereof. The translucent character of layer 124 allows the metallic layer 122 to show through, yet the metallic layer 122 is modified through the prism of the translucent layer 124. The combined effect of the metallic and translucent layer creates a unique look, whereby there is a perception of depth and luster. In addition, the colors are stark and pure as they are unaffected by the natural color of the underlying nail.

It will be understood that translucent color layer 124 (alternatively "color-modifying" layer) can be any of various colors or combinations of colors. Preferably, such color(s) is different from the color of the underlying metallic layer 122. In this manner, the visible appearance of the underlying metallic layer 122 is modified by the color(s) of the color layer 124. It will be further understood that color layer 124 can be provided at various degrees of translucence all of which are within the scope of the invention. The sheen of the underlying metallic layer 122, the color of the color-modifying layer 124 and the degree of translucence thereof—each cooperatively contribute to the overall appearance of the appliqué. Each one of these properties could be adjusted in order to produce various different appearances and effects in different embodiments of the invention.

Examples of metallic materials that may be used in metallic layer 122 in accordance with the above-mentioned embodiments include, but are not limited to, copper, chrome, pewter and metallic flakes.

It will be understood by those of ordinary skill in the art that color-hiding layer 122 may be of any of various colors, which serve to obscure the color of an underlying nail bed in manner that hides the natural nail color and thereby prevents the natural nail color from interfering with a nail polish layer.

Optionally, once the color-hiding 122 and color 124 layers are applied, one or more clear layers 126 are applied on top thereof. As shown in FIG. 8, a clear enamel coat 126 is applied on top of layers 122 and 124. In this embodiment, layers 122 and 124 contribute to the color appearance of the nail (layer 122 either being visible through layer 124—or layer 122 serving to hide the nail bed, and not otherwise outwardly visible) and the top, clear coat 126 adds a glossy finish, but it does not otherwise contribute to the color of the appliqué.

Figure 9:
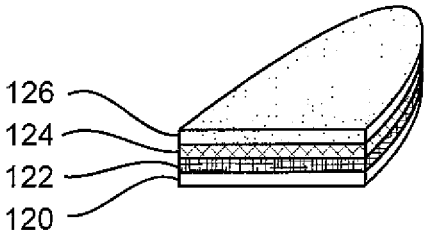
FIG. 9 is a schematic view of a nail appliqué having four layers—with mica added to a clear layer according to an embodiment of the invention.
Figure 10:
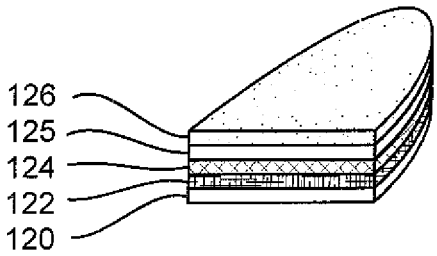
FIGS. 10 and 11 are schematic views of a nail appliqué having five two clear layers—one of which contains mica according to an embodiment of the invention.
Figure 11:
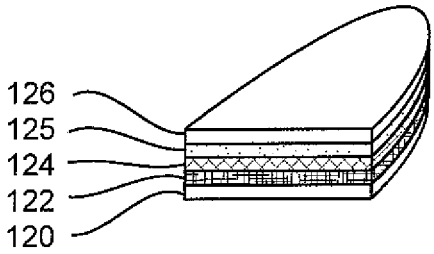

In some embodiments, however, the top, clear coat 126 contributes to the overall color and look of an appliqué. In this embodiment, one or more of the clear layers are provided with glitter, mica or other enhancing particulate material. For example, referring to FIG. 9, top, clear layer 126 contains mica or the like. In FIG. 10, two clear coats are applied, the top 126 one of which comprises mica and the coat 125 therebelow does not. In another embodiment shown in FIG. 11, two clear layers are applied—the bottom clear layer 125 contains mica, whereas the layer 126 thereabove does not. In these embodiments, at least three layers complementarily produce a unique visual appearance. That is, the color-hiding layer 122, modified through the prism of translucent layer 124 and further enhanced by a mica-containing layer thereabove combine to create a brilliantly colorful look that has texture and depth.

The configurations of the layers mentioned herein should be understood to be describing the general position of layers with respect to each other. That is, the adhesive layer is the lowermost layer, and a color-hiding layer is disposed below a color-modifying layer. However, it is possible that other layers may be disposed between any of the layers mentioned herein. As an example, after the adhesive layer is applied, a separate layer may be applied thereabove and then after that the color-hiding layer is applied. In this example, the color-hiding layer is positioned above of the adhesive layer—but not directly so.

Having described this invention with regard to specific embodiments, it is to be understood that the description is not meant as a limitation since further modifications and variations may be apparent or may suggest themselves to those skilled in the art. It is intended that the present application cover all such modifications and variation as fall within the scope of the appended claims.

What is claimed is:

1. A nail polish appliqué comprising:

an adhesive layer applied atop a substrate;

a first nail enamel layer applied atop said adhesive layer and having a first color, said first enamel layer comprising partially dried enamel; and, a second nail enamel layer applied atop said first color layer and having a second color different from said first color, said second nail enamel layer comprising partially dried enamel, said second nail enamel layer being translucent such that said first nail enamel layer is at least partially visible through said second nail enamel layer, said first nail enamel layer blocking the passage of a color of a nail therethrough when said nail polish appliqué is applied to the nail such that the color of the nail is inhibited from showing through said second nail enamel layer and affecting the appearance of said second nail enamel layer, said second nail enamel layer covering the entire upper surface of said first nail enamel layer such that said first and second colors of said first and second nail enamel layers, respectively, combine to provide an enhanced color appearance to said nail polish appliqué, said substrate, said first nail enamel layer and said second nail enamel layer being substantially nail-shaped.

2. The nail polish appliqué of claim 1, wherein said first nail enamel layer is a shade of white.

3. The nail polish appliqué of claim 1, wherein said first nail enamel layer comprises a metallic material.

4. The nail polish appliqué of claim 3, wherein said metallic material comprises a material selected from the group consisting of aluminum, copper, chrome, pewter and metallic flakes.

5. The nail polish appliqué of claim 1, wherein said first nail enamel layer comprises a metallic finish.

6. The nail polish appliqué of claim 1, wherein said first nail enamel layer comprises nail enamel in a shade of white.

7. The nail polish appliqué of claim 1, wherein said first nail enamel layer comprises nail enamel in a shade of white and said second nail enamel layer comprises neon-colored enamel having a translucent quality.

8. The nail polish appliqué of claim 1, further comprising a top coat comprising clear nail enamel applied atop said second nail enamel layer.

9. The nail polish appliqué of claim 8, wherein said top coat comprises a particulate material.

10. The nail polish appliqué of claim 9, wherein said particulate material comprises mica or glitter.

11. A method of making a nail polish appliqué, comprising the steps of:

applying an adhesive layer to a substrate;

applying a first nail enamel layer atop said adhesive layer, said first nail enamel layer having a first color;

partially drying said first nail enamel layer;

applying a second nail enamel layer atop said first nail enamel layer after the performance of said step of partially drying said first nail enamel layer, said second layer having a second color different from said first color;

partially drying said second nail enamel layer; and cutting said substrate and said first and second nail enamel layers into a substantially nail-shaped appliqué after the performance of said step of partially drying said second nail enamel layer, said second nail enamel layer being translucent such that said first nail enamel layer is at least partially visible through said second nail enamel layer, said first nail enamel layer blocking the passage of a color of a nail therethrough when said appliqué is applied to the nail such that the color of the nail is inhibited from showing through said second nail enamel layer and affecting the appearance of said second nail enamel layer, said second nail enamel layer of said appliqué covering the entire upper surface of said first nail enamel layer of said appliqué such that said first and second colors of said first and second nail enamel layers, respectively, combine to provide an enhanced color appearance to said appliqué.

12. The method of claim 11, wherein said first color is a shade of white.

13. The method of claim 11, wherein said first nail enamel layer comprises a metallic material.

14. The method of claim 13, wherein said metallic material is selected from the group consisting of aluminum, copper, chrome, pewter and metallic flakes.

15. The method of claim 11, further comprising the step of applying a clear nail enamel layer atop said second nail enamel layer after the performance of said step of partially drying said second nail enamel layer.

16. The method of claim 15, wherein said clear layer comprises a particulate material.

* * * * *